US006012372A

United States Patent [19]

Laster et al.

[11] Patent Number: 6,012,372

[45] Date of Patent: Jan. 11, 2000

[54] ADJUSTABLE ARBOR AND CUTTING ELEMENTS

[76] Inventors: James E. Laster, 3807 Derbyshire Dr., Greensboro, N.C. 27410; Frank Walton York, Jr., 7707 Knollcrest Dr., Greensboro, N.C. 27407

[21] Appl. No.: 08/588,413

[22] Filed: Jan. 18, 1996

[51] Int. Cl.[7] ..... B26D 7/26; B27B 5/34

[52] U.S. Cl. ..... 83/665; 83/504; 83/508.3; 83/698.61

[58] Field of Search ..... 83/425.4, 481, 83/508.2, 508.3, 665, 698.51, 698.61, 498, 499, 504, 507, 666, 698.41; 403/5; 493/366, 367

[56] References Cited

U.S. PATENT DOCUMENTS

| | | | |
|---|---|---|---|
| 3,422,714 | 1/1969 | Van Gompel et al. | 83/665 X |
| 3,782,234 | 1/1974 | Rodach | 83/665 |
| 3,951,024 | 4/1976 | Weiskopf | 83/498 |
| 4,006,671 | 2/1977 | Ochs | 83/504 X |
| 4,026,176 | 5/1977 | Weiskopf | 83/504 X |
| 4,033,217 | 7/1977 | Flaum et al. | 83/499 X |
| 4,162,643 | 7/1979 | Coburn | 83/499 |
| 4,214,495 | 7/1980 | Coburn | 83/499 X |
| 4,224,847 | 9/1980 | Tokuno | 83/499 X |
| 4,230,009 | 10/1980 | Coburn | 83/504 |
| 4,237,761 | 12/1980 | Coburn | 83/499 X |
| 4,285,684 | 8/1981 | Smith | 83/665 X |
| 4,561,355 | 12/1985 | Cuir et al. | 83/698.41 X |
| 4,646,603 | 3/1987 | Held | 83/425.4 |
| 4,732,083 | 3/1988 | Arter et al. | 83/665 X |
| 4,759,249 | 7/1988 | Held | 83/508.3 X |
| 5,074,180 | 12/1991 | Mayer et al. | 83/698.61 X |
| 5,293,798 | 3/1994 | Otani et al. | 83/508.3 X |
| 5,325,751 | 7/1994 | Green et al. | 83/508.3 X |
| 5,735,184 | 4/1998 | Miller et al. | 83/504 |

FOREIGN PATENT DOCUMENTS

| | | | |
|---|---|---|---|
| 580381 | 7/1959 | Canada | 83/499 |

*Primary Examiner*—Clark F. Dexter

[57] ABSTRACT

An adjustable arbor for maintaining one or more cutting elements which includes a shaft, one or more runners associated with the shaft and runner displacing pistons aligned with the runners and selectively displacing them to engage the cutting elements and secure those elements to the shaft. The runner displacing pistons are activated by pressurized fluid passing through channels communicating with the pistons and are relaxed when the fluid source is deactivated. The runners are urged radially upwardly against a cutting element holding ring when activated and are withdrawn when deactivated so that the cutting elements can be rearranged on the shaft.

3 Claims, 3 Drawing Sheets

ADJUSTABLE ARBOR AND CUTTING ELEMENTS

BACKGROUND

1. Field of the Invention

This invention relates to an arbor for maintaining one or more cutting elements in an operable position and more particularly, to an adjustable arbor for maintaining one or more cutting elements that can be selectively activated and deactivated to quickly position and tighten multiple cutting elements on a shaft without removing the elements from the shaft.

2. Description of Prior Art

Cutting devices such as saws and the like are used in numerous woodworking industries to fashion wooden parts for various components to be made. In particular, the furniture industry uses many varieties of cutting elements for cutting various types of wood materials and for cutting various shapes of wooden members, particularly long, narrow strips which are used in numerous lines of furniture. A particularly important sawing device is used to rip long strips of wood to form framing in upholstered furniture, defect-free components, and defect-free glue stock used to make panels or other furniture components.

Specialty knifes such as those mentioned above are made up of a plurality of spaced apart saws on an arbor driven by a common power source so that multiple strips of wood can be ripped in a single pass. These are frequently needed, and every furniture manufacturing facility utilizes a saw similar to the one described.

The specialty saw referenced above is normally prepared for operation by sliding on a plurality of saw blades on the common shaft with these blades being spaced apart by spacers measured precisely to result in the cutting of strips of a specific width. More than one width may be cut on a single pass, and several strips can result from a single pass. Once the cutting requirements of a specific group of sizes have been reached, the saw must be deactivated, and the blades must be changed to different spacings to accommodate and provide the next batch of strip material.

Using the conventional saw having blade spacers requires all blades to be removed with the exception of perhaps the farthermost blade when strip widths are changed. Thus, the blades and the spacers separating them all come off so that the shaft can be reconfigured with new spacers and blades to give appropriate spacings for cutting. This is a time-consuming process, and the attendant downtime arising from the blade changing operation is troublesome, non-productive and inconvenient.

Thus, there is perceived a need for a quick change gripping saw of the type described that will eliminate the removal of all blades and spacers from the shaft when reconfiguration is required and that will eliminate the need for spacers altogether if at all possible. It is to this need that the present invention is directed.

SUMMARY OF THE INVENTION

The present invention eliminates the need to use spacers and to remove essentially all blades when reconfiguring the shaft for new cutting widths. It is an adjustable arbor for maintaining one or more cutting elements comprising a shaft, one or more runners associated with the shaft and runner displacing pistons communicating with the runners and selectively displacing the runners to engage the cutting elements and secure the cutting elements to the shaft. The displacement means includes one or more bores formed with the shaft, piston-communicating channels connecting with the bores, inserts connecting with the communicating channels, and pistons mounted and movable within the inserts and engaging the runners for displacement. The arbor is selectively operable by activating and deactivating a fluid under pressure to displace the pistons against the runners and to relieve the pressure so that the runners can relax and allow the cutting elements to move freely on the shaft.

From the foregoing summary, it can be seen that a primary objective of the present invention is to provide an adjustable arbor for maintaining one or more cutting elements, which has all of the advantages of prior art devices and none of the disadvantages.

Another objective of the present invention is to provide an adjustable arbor of the type described which avoids the need of using blade spacers to establish cutting widths for ripping wooden strips.

Yet another objective of the present invention is to provide an adjustable arbor of the type described that utilizes a pressurized fluid source to operate the system for tightening and selectively relaxing the blades mounted on a shaft.

Yet still another objective of the present invention is to provide an adjustable arbor of the type described which employs a plurality of linearly positioned pistons to selectively activate and deactivate the runners that secure the blades in a locked, operable position and form the torque transfer from the arbor to the cutting elements.

Thus, there has been outlined the more important features of the invention in order that the detailed description that follows may be better understood and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the arrangement of the components set forth in the following description or illustrated in the drawings. The invention is capable of other embodiments and of being practiced and carried out in various ways.

It is also to be understood that the phraseology and terminology employed herein are for the purpose of description and should not be regarded as limiting in any respect. Those skilled in the art will appreciate that the concept upon which this disclosure is based may readily be utilized as a basis for designing other structures, methods and systems for carrying out the several purposes of this development.

It is important that the claims be regarded as including such equivalent methods and products resulting therefrom that do not depart from the spirit and scope of the present invention. The specification is neither intended to define the invention of the application, which is measured by its claims, nor to limit its scope in any way.

Thus, the objects of the invention set forth above, along with the various features of novelty which characterize the invention, are noted with particularity in the claims annexed to and forming a part of this disclosure. For a better understanding of the invention, its operating advantages, and the specific results obtained by its use, reference should be made to the following detailed specification taken in conjunction with the accompanying drawings wherein like characters of reference designate like parts throughout the several views.

DETAILED DESCRIPTION OF THE PREFERRED EMBODIMENT

Figure 1:
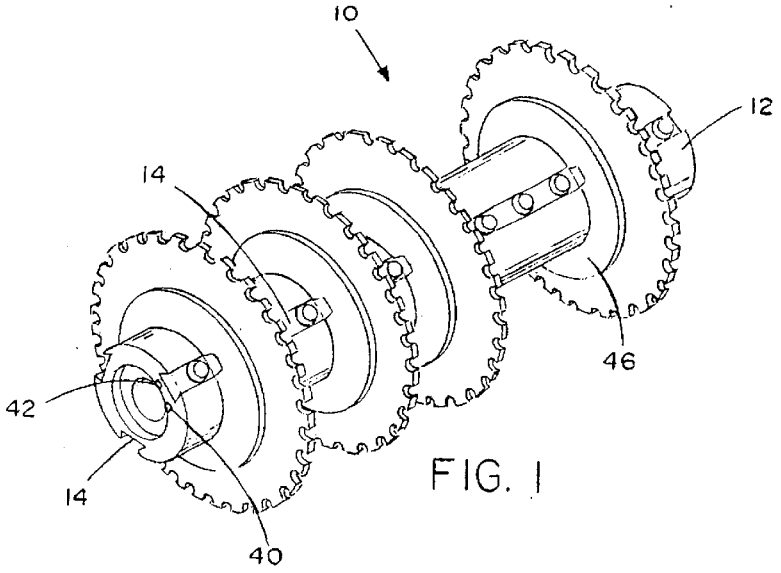
FIG. 1 is a perspective view of the adjustable arbor comprising the present invention showing a number of randomly placed saw blades affixed to its surface.
Figure 2:
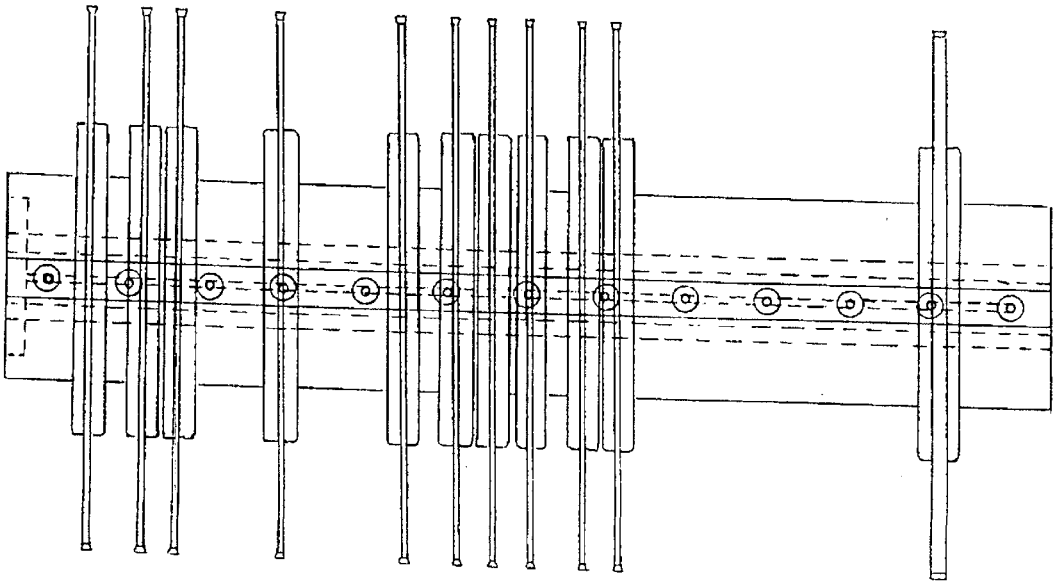
FIG. 2 is a side elevational view of a programmed adjustable arbor of the present invention showing a plurality of saw blades strategically positioned along its length to cut strips of varying widths.
Figure 3:
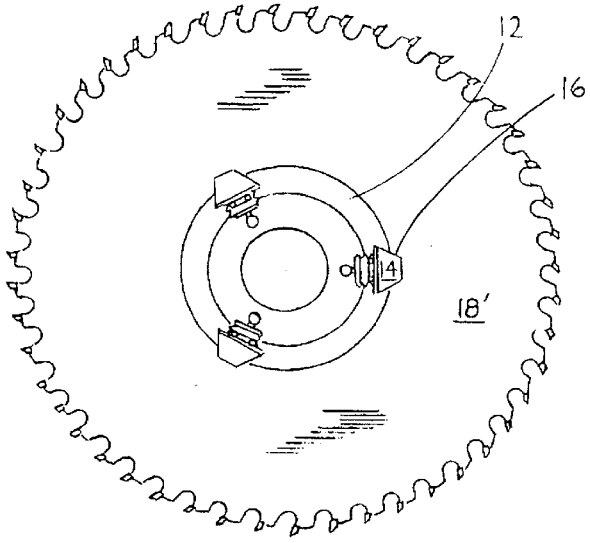
FIG. 3 is an end elevational view of the adjustable arbor shown in FIG. 2.
Figure 10:
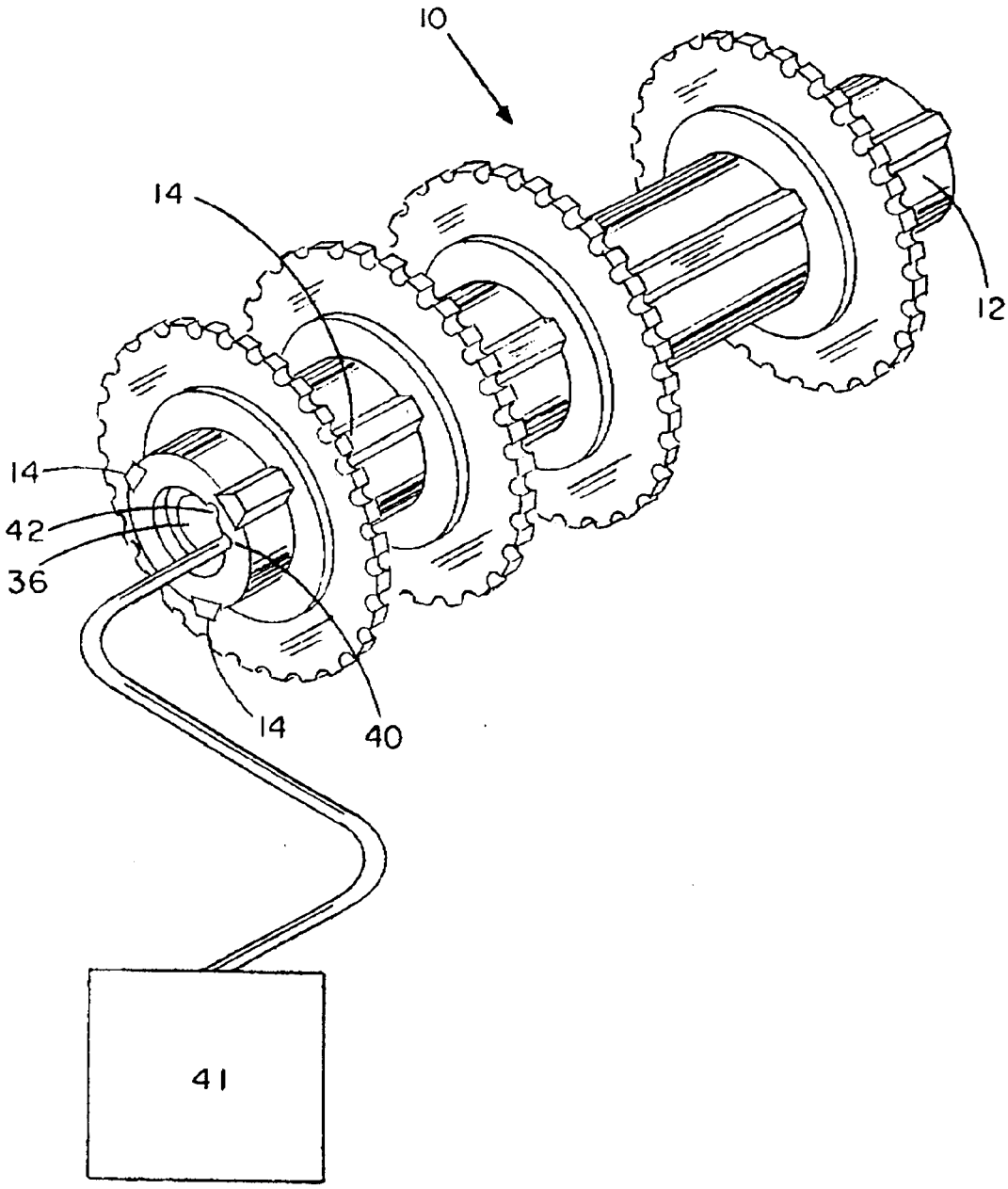
FIG. 10 is a perspective view of the adjustable arbor comprising the present invention showing the invention with the runners in place on the shaft.

Referring now to the drawings and particularly to FIG. 1, the adjustable arbor shown generally as 10 comprising the present invention, includes a shaft 12 and one or more runners 14 recessed within the shaft surface that extend for the entire length of the shaft. Runners 14 are displacable along the cross sectional radius of shaft 12 for a small distance so as to engage cooperating recesses 60 in blade holder 46 as shown in FIGS. 1 and 10, or alternately, to engage in cooperating recesses 16 in blade 18, as best shown in FIG. 3. When runner 14 moves radially outwardly toward blade 18, it is urged against slot 16 to lock blade 18 into position.

Figure 4:
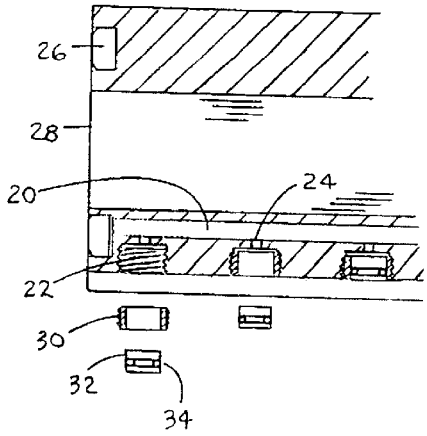
FIG. 4 is a sectional and fragmentary view of the shaft of the adjustable arbor comprising the present invention showing the connection of the bores to a plurality of piston housing inserts for actuation of the pistons.

A plurality of bores 20 run through the entire length of shaft 12 and provide a fluid passage that ultimately controls the operation of runners 14. A plurality of threaded holes 22 are drilled radially into shaft 12 and are ultimately connected by another small bore 24 as shown in FIG. 4. A reservoir 26 is circumferentially formed in the end 28 of shaft 12 and connects with the longitudinal bores 20.

A threaded insert 30 is screwed into drilled hole 22 (FIG. 4) and an appropriately sized piston 32 with a sealing O-ring 34 is inserted therein. Thus, piston 32 is movable within threaded insert 30 and is directly exposed to bore 24 containing fluid either under pressure or in a relaxed state. A bronze bushing 36 (FIG. 6) slides within the shaft interior 38 and frictionally engages the driving shaft (not shown) associated with the arbor comprising the present invention. Fluid under pressure is selectively introduced into the system at port 40 by suitable pressure means 41; and pressure is released from the system through pressure relief control outlet 42 through which the fluid under pressure is released to thereby relax and allow inward displacement of runners 14.

Figure 6:
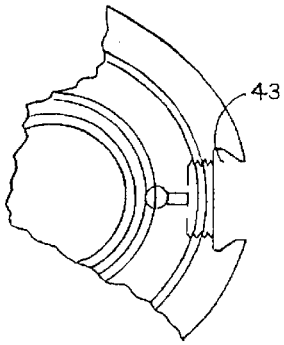
FIGS. 6 and 7 are end elevational views of the shaft of the adjustable arbor comprising the present invention, FIG. 7 showing additional bores connecting the longitudinal bores formed under the piston housings and the runner holding slots on the surface of the shaft.
Figure 5:
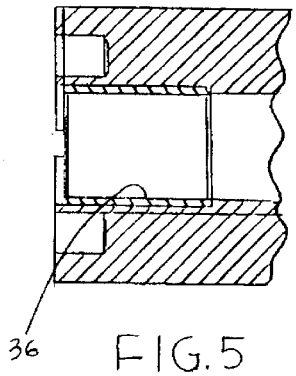
FIG. 5 is a sectional and fragmentary view of the shaft of the adjustable arbor showing the inclusion of a bronze bushing.
Figure 7:
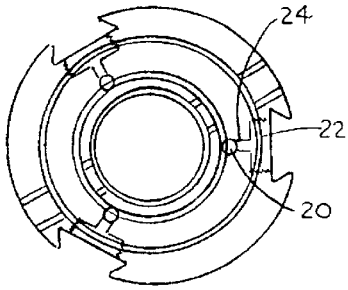
Figure 8:
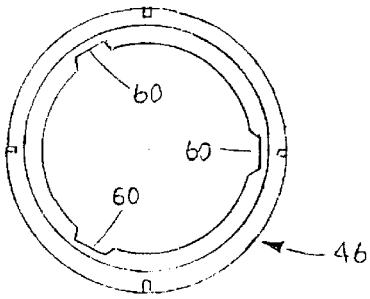
FIG. 8. is an end elevational view of the blade or cutting element holder utilized with the present invention.

The runner retaining groove 43 the 14 therein is best shown in FIGS. 6 and 7. The cross-sectional configuration of runner 14 is such that it moves outwardly from groove 43 to only a small portion of each edge engaging the structure of the shaft within groove 43.

When the system is filled with fluid, only a small amount of fluid need be introduced through port 40 to activate the pistons and thereby displace runners 14 into saw notches 16. It has been found satisfactory to use a fluid pressure of approximately 2,000 psi to accomplish this fluid and runner activation, and only a small amount of the fluid emerges from the system when pressure relief control is adjusted to permit fluid to flow through port 40. Grease is a fluid that can be used as the fluid to accomplish this fluid and runner activation.

Thus, there has been described an adjustable arbor for maintaining a plurality of cutting elements, usually blades, which can be selectively operated to allow blade repositioning without removing the blades from the shaft. In the embodiment shown, three runners 14 are positioned equidistant from each other around the shaft periphery and reside in grooves 43 for the entire length of the shaft. Fluid-carrying bores extend from a reservoir at the end of the shaft down the length of the shaft under each runner and are all interconnected. Pistons are positioned along the length of each runner. When the pistons are displaced by invasion of the fluid, the pistons displace the runner 14.

Figure 9:
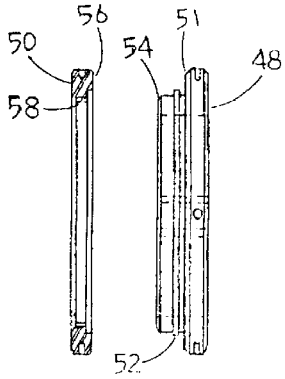
FIG. 9 is a sectional view of the two parts of the blade holder.

The two parts of the blade holder shown generally as 46 are shown in FIG. 9 and designated 48, 50. Component 48 has a first shoulder 51, a blade engaging edge 52 and a threaded shank 54. Component 50 provides a second shoulder 56 and a threaded interior 58. In use, the blade 18 slides over the threaded shank and rests on element 52. One side of the blade engages shoulder 51 at that time. Component 50 is then threaded over threaded shank 54 and tightened against the other side of the blade until shoulder 56 firmly seats the blade in a fixed condition.

Slots 60 correspond to recesses 16. When each runner 14 moves radially outwardly toward blade 18 and its cooperating slot 60, it is urged against its slot to lock the blade into position.

Other variations can be made in the adjustable arbor of the present invention including reducing the mass of shaft 12 by making its cross section substantially triangular in configuration, leaving only grooves 43 at their location shown in FIG. 3, but removing some of the curved structure of the shaft between adjacent grooves 43. Other economies can be effected by making various appropriate changes.

With respect to the present invention, it is to be realized that the techniques involved in forming the novel combination set forth herein and the components associated therewith are unlimited. All equivalent relationships to those illustrated in the drawings and described in the specification are intended to be encompassed herein. The following is considered as illustrative only of the principles of the invention. Since numerous modifications and changes will readily occur to those skilled in the art, it is not desired to limit the invention to the exact construction and operation shown and described. All suitable modifications and equivalents that fall within the scope of the appended claims are deemed within the present inventive concept.

What is claimed is:

1. An adjustable arbor maintaining at least one cutting element thereon comprising:

a shaft;

at least one runner carried by the shaft;

the at least one cutting element mounted on the shaft, wherein the at least one runner is disposed between the shaft and the at least one cutting element, whereby the cutting elements are movable on the shaft when not engaged by the runners; and runner displacement means for displacing the runners to engage the cutting elements and secure the cutting elements to the shaft, wherein the runner displacement means includes:

at least one bore formed within the shaft, at least one hole formed in the shaft and communicating with one of the bores, at least one insert, each insert mounted in one of the holes, and at least one piston, each piston movably mounted within one of the inserts for extending from and receding into the insert and mounted for independent movement with respect to a corresponding one of the runners, wherein each piston is in communication with one of the bores so that when the runner displacement means is pressurized, each piston extends and engages its corresponding runner to displace the runners against the cutting elements and secure the cutting elements to the shaft, and when the runner displacement means is not pressurized, the pistons are free to recede into the inserts allowing the runners to recede inwardly away from the cutting elements so that the cutting elements may be adjusted on the shaft.

2. The arbor as claimed in claim 1 wherein the shaft includes a bushing positioned therein.

3. The arbor as claimed in claim 1 wherein the runner displacement means further comprises a port communicating with the at least one bore for introduction of pressure into the at least one bore to extend the pistons so that the pistons engage the runners and move the runners against the cutting elements.

* * * * *